US007549784B1

(12) United States Patent
Teeters

(10) Patent No.: US 7,549,784 B1
(45) Date of Patent: Jun. 23, 2009

(54) LED LIGHTING FOR GLASS TILES

(75) Inventor: Rachel Teeters, Marietta, GA (US)

(73) Assignee: New Horizon Designs, Inc., Marietta, GA (US)

( * ) Notice: Subject to any disclaimer, the term of this patent is extended or adjusted under 35 U.S.C. 154(b) by 0 days.

(21) Appl. No.: 11/951,794

(22) Filed: Dec. 6, 2007

(51) Int. Cl.
*F21S 4/00* (2006.01)

(52) U.S. Cl. ..... 362/576; 362/145; 362/147; 362/153; 362/235; 362/222; 362/223; 52/306; 52/390; 52/747.11

(58) Field of Classification Search ..... None
See application file for complete search history.

(56) References Cited

U.S. PATENT DOCUMENTS

| | | | | | |
|---|---|---|---|---|---|
| 2,135,118 | A | * | 11/1938 | Stewart | 52/396.1 |
| 2,587,855 | A | | 3/1952 | Johnson | |
| 3,817,012 | A | * | 6/1974 | Wack et al. | 52/315 |
| 4,340,929 | A | | 7/1982 | Konikoff et al. | |
| 5,107,408 | A | | 4/1992 | Vernondier | |
| 5,321,593 | A | | 6/1994 | Moates | |
| 5,411,791 | A | * | 5/1995 | Forry et al. | 428/210 |
| 5,559,681 | A | * | 9/1996 | Duarte | 362/252 |
| 5,769,533 | A | * | 6/1998 | Yamuro et al. | 362/249 |
| 6,732,478 | B1 | | 5/2004 | Russell et al. | |
| 6,739,735 | B2 | | 5/2004 | Talamo et al. | |
| 6,857,230 | B2 | | 2/2005 | Owen | |
| 6,929,382 | B2 | | 8/2005 | Kuisma | |
| 7,125,137 | B2 | | 10/2006 | Kitajima et al. | |
| 2004/0240230 | A1 | * | 12/2004 | Kitajima et al. | 362/558 |
| 2005/0116667 | A1 | | 6/2005 | Mueller et al. | |
| 2005/0257436 | A1 | | 11/2005 | Vanderpol | |
| 2006/0197474 | A1 | * | 9/2006 | Olsen | 315/312 |
| 2007/0133193 | A1 | * | 6/2007 | Kim | 362/147 |

* cited by examiner

*Primary Examiner*—Sandra L O'Shea
*Assistant Examiner*—Danielle Allen
(74) *Attorney, Agent, or Firm*—Brian S. Steinberger; Law Offices of Brian S. Steinberger, P.A.

(57) ABSTRACT

Devices, apparatus, systems, and methods of installing LED (light emitting diodes) for glass tiles and glass blocks. The LEDs can be housed in flexible strips having flexible bendable transparent housing sleeves with ends that can interconnect by male and female ends to one another with various types of interconnectors. Each separate sleeve can house up to 33 LEDs in a transparent plastic sleeve. A transparent connector sleeve can be slid over the interconnected ends and heat shrunk in place. The glass tiles can be laid out to uniform joints spacings between the glass tiles of approximately 3/16 of an inch. The LED strips can be placed on a surface layer of transparent grout that has been laid in the joint spacing, followed by a top layer of transparent grout. The transparent grout can be removable grout and include clear Silicon. The LED strips can have peel and stick back layers with adhesive backing that allows mounting to the lower surface. The LED strips can be placed with glass tiles, and other types of tiles such as but not limited to ceramic tiles, stone tiles and the like, as well as with glass blocks. Splitter(s) can be used to run parallel runs of LED strips at different spaced apart locations.

13 Claims, 19 Drawing Sheets

LED LIGHTING FOR GLASS TILES

This invention relates to lighting, in particular to devices, apparatus, systems, and methods of installing LED (light emitting diodes) for glass tiles and glass blocks.

BACKGROUND AND PRIOR ART

Glass tiles for walls and floors have become increasingly popular to allow light transmission therethrough and there have been developments to light these tiles to show off their colors. Various types of lighting have included glass bulbs. However, bulbs do not have a long life and removing such bulbs would be expensive and time consuming.

Another way to provide lighting for these tiles is to use fiber optics that are powered by a halogen light sources. However, fiber optic lighting systems are expensive to install and require a lot of energy to light the tiles.

Light emitting diodes (LED's) have been considered in the past as a light source for lighting glass tiles. But it has always required a modification of the basic tile design to receive the LED's. LEDS have been installed underneath the tiles, so once the tiles are in place and are grouted the LED tile assembly becomes permanent. Since the LED's have a life of a several years, the tiles would then have to be removed and the LED's replaced. Replacement and reinstallation is a very time consuming and costly process that does not make using this type of installation of LED's a very viable option in lighting the glass tiles especially since glass tiles are also expensive.

Various types of illumination devices have been proposed over the years for lighting walls and floors and other areas. See for example, U.S. Pat. Nos. 2,587,855 to Johnson; 4,340,929 to Konikoff et al.; 5,107,408 to Vernondier; 5,321,593 to Moates; 5,559,681 to Duarte; 6,732,478 to Russell et al.; 6,739,735 to Talamo et al.; 6,857,230 to Owen; 6,929,382 to Kuisma; 7,125,137 to Kitajima et al.; and U.S. Published Patent Applications 2005/0116667 to Mueller; 2005/0257436 to Vanderpol; 2006/0197474 to Osen; and 2007/0133193 to Kim. However, none of these devices and systems overcome all the problems with the prior art described above.

Thus, the need exists for solutions to the above problems with the prior art.

SUMMARY OF THE INVENTION

A primary objective of the present invention is to provide devices, apparatus, systems, and methods of installing LED (light emitting diodes) for glass tiles and glass blocks where a replaceable LED strip can be placed in between the tiles and blocks, on corners, horizontal and/or vertical grout lines in multiple directions through the glass tiles and blocks that transmits a pleasant light effect therethrough.

A secondary objective of the present invention is to provide devices, apparatus, systems, and methods of installing LED (light emitting diodes) with tiles and glass blocks where an LED (light emitting diode) strip can be placed in a clear silicone or transparent grout and subsequently grouted to match the grout that is between any combination of glass tiles, glass blocks standard ceramic and stone tiles.

A third objective of the present invention is to provide devices, apparatus, systems, and methods of installing LED (light emitting diodes) for glass tiles and glass blocks where the LED strip can be any color currently manufactured by the LED industry including those LED's that can change color through the entire color spectrum.

A fourth objective of the present invention is to provide devices, apparatus, systems, and methods of installing LED (light emitting diodes) for glass tiles and glass blocks where the LEDs can be pulsed or dimmed to give any type of effect on the floor or wall that is required by the owner, by adjusting certain electronic control. The invention can also be used in conjunction with a music sound system to pulse the light to the beat of the music.

A fifth objective of the present invention is to provide devices, apparatus, systems, and methods of installing LED (light emitting diodes) for glass tiles and glass blocks where the LED strip can be interchangeable and replaceable because the clear silicone or transparent grout and any other colored grout is removable. The LED strips can be used on any size tile and on any thickness tile as long as it is over approximately 6 mm minimum safety standpoint. The strips can have set current and wattage restrictions and be properly matched with a power source to give the LED's long life. The strips can come in rolls or single strips. The strips can be made into any shape or a plurality of shapes. They can be located under the tile or located at the sides of the tile. The strips can be used indoors or outdoors as well as in bathrooms, kitchens, bedrooms.

A sixth objective of the present invention is to provide devices, apparatus, systems, and methods of installing LED (light emitting diodes) for glass tiles and glass blocks where the LED strips can be incased in a plastic material that is resistant to damage from the sun or exposure to harsh cleaning chemical or any typically marketed tile and glass cleaners. The plastic can be sufficiently fire retardant to meet all UL guidelines regulating LEDs. The plastic material can protect the LED from all forms of moisture and corrosion for all outdoor applications as well as when the initial clear silicone or transparent grout is applied.

The invention encompasses an LED lighting system for glass tiles and methods of installation. The system and method has four components: the LED strip, a Splitter, a clear silicone or transparent grout, and the power/control low voltage transformer-system. The LEDs are built into a flexible strip that allow up to 45 degrees of bending. They are also modular and come in a plurality of length that have snap on male/female connectors at each end that allow the connection of individual strips together and allow for the connection of a low voltage power source and control mechanism. Each strip may have an adhesive backing that would allow the attachment of the LED strip to the mounting surface that the glass tiles are being placed on. These LED strips can be monochromatic, in a plurality of single colors or use LED's capable of change colors throughout the color spectrum using a control device combined in the power source.

The second component of this glass tile lighting system and method is the use of a clear silicone or transparent grout that to be applied between the tiles and over the LED strips. The silicone or transparent grout will act as a bonding agent that will bond each tile to another glass tiles and to the LED strip. Thus, securing the glass tiles and the LED strips into a single mass and allowing the light from the LED strips to shine through the silicone or transparent grout and into the tiles or outward towards the observer. This grout will also have the ability to be easily removed so that any damaged or inoperative LED strips can be easily removed and replaced.

The third component of the glass tile lighting system is the low voltage transformer power/control system that will run along a hidden edge of the tile pattern can be quick connected to the LED strips in the same manner that the strips are connected together. The power and control system will supply the low voltage power to the LED strips as well as allow the strips to be dimmed or colors to be changed (if they are made up of LED's that can be shifted through the color spectrum) or turned on and off, blinked in pre-programmed patterns.

The fourth component of the glass tile lighting system is the Splitter. This facilitates the connection between the transformer and the LED light strip. It allows for multiple LED light strips to operate from a single transformer power source.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
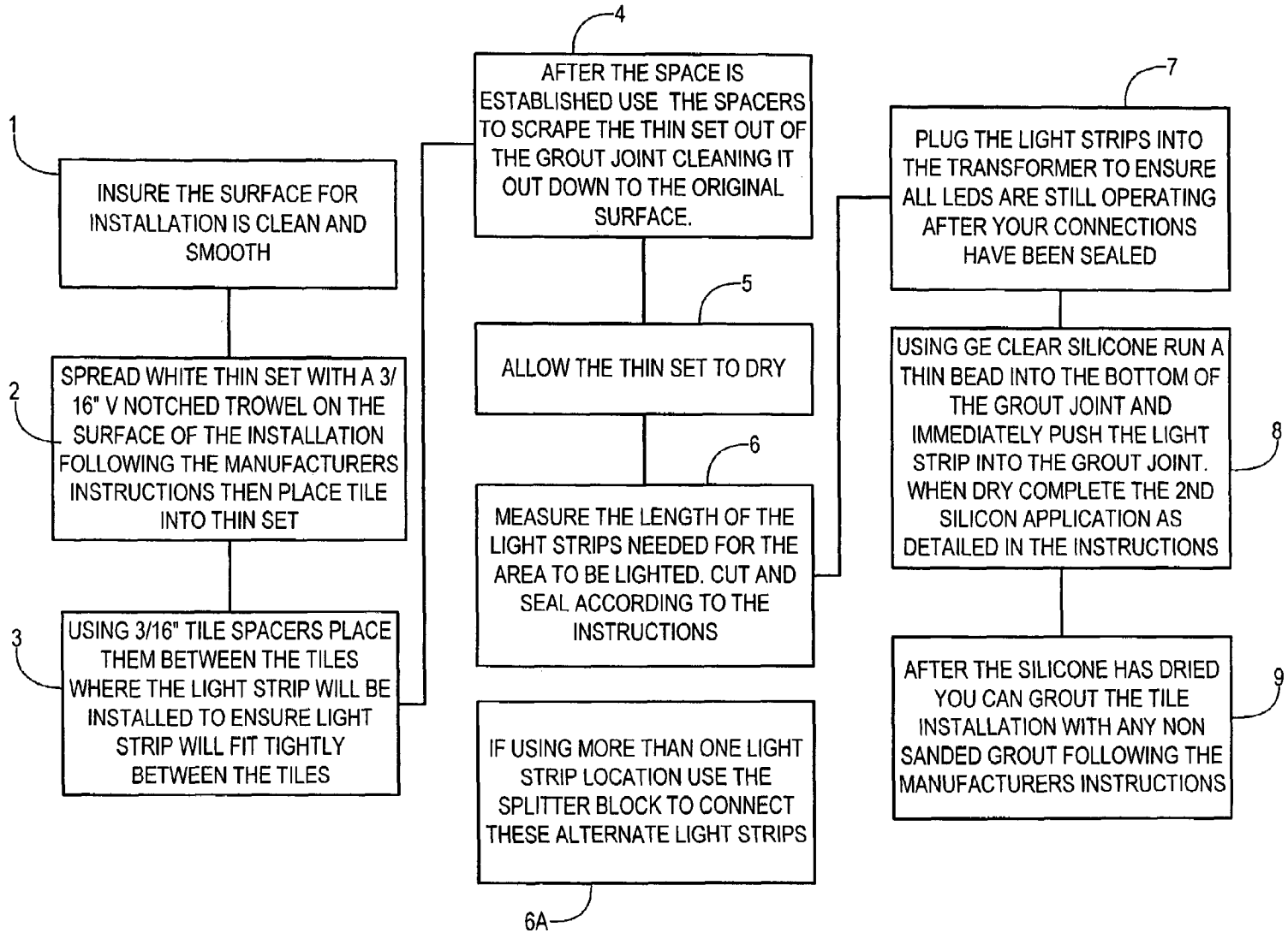
FIG. 1 shows flow chart of a preferred installation process steps for installing the novel LED light strips.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Tiles have been around since the Roman times, and Cement/grout has provided a good way of securing the tiles to a surface, that have lasted through the ages. Regular tiles are in every application for building throughout the world for indoor and outdoor purposes. There is a state of art in the technology of installing tiles, of reliably and handling tiles that is a known art.

Glass tiles are relatively new and were introduced under Tiffany during the Art Deco period. Tiffany produced some tiles that were used in flooring. These were very specialized and they had a metal band made from lead, bronze or copper material that provided the bonding between each of the glass tiles. In this case, most were like stained glass than actual tiles. What is unique about glass tiles today is they have taken the concept of the general tiles with matting on the back which allow for a one foot square or any other dimension that can be easily applied in any application throughout the building process as does the more common ceramic or stone tiles.

The invention combines an—LED tile lighting system combined with a novel method of applying grout to the glass tile—that can allow the glass tiles to become a light source which is a unique concept and new over the background. The glass tile arena has moved from merely decorative to a much more utilitarian use by adding light. This now adds function to the glass tiles by allowing the designs of the tiles and the surface they are mounted on to be illuminated. This will eliminate the need for separate lighting, shedding light on the tiles, which could be used as a night light, walk lighting for a porch or foyer, ambience lighting. In addition, the light is reflected through the glass tiles and can provide a prismatic and refracted effect which can give unique characteristics to the design and beauty of the glass tiles once they are illuminated.

A listing of the labeled components will now be described.

1. Step 1
2. Step 2
3. Step 3
4. Step 4
5. Step 5
6. Step 6
6A Step 6A
7. Step 7
8. Step 8
9. Step 9
10. System embodiment
20. Transformer
22. Male prong end
23. Light Color Conductor (positive)
24. thickened end
25. Dark Color Conductor (negative)
26. main housing
28. power receptical male plug
30. interconnect tube
40. interconnect tube
50. end cap

60 alternative transformer
62. plural male prong lines
66. main housing
64. power line
68. three prong plug
70. alternative strip interconnector with opposite facing prongs
72. double prongs on top end
75. middle enlarged section
78. double prongs on bottom end
80 alternative strip connector, cross shape with four prong ends
100. LED light strip
110. female receptical end
190 male prong end
200 LED light strip
210. female receptical end
290 male prong end
400. surface for tile application
450. power control base
490. solar power source
500. tile application
510. glass tile
520. glass tile
530. glass tile
540. glass tile
590. joint spacing between tiles
600. transparent removable grout
700. roll of LED light strips
710. removable rear layer exposes adhesive surface of strips
715. exposed adhesive backing surface
800 Splitter
801 Transformer Line Connectors
802 negative terminal for transformer line Dark Color
804 positive terminal for transformer line Light color
810 First Lead Line Connectors
811 input socket for positive terminal
812 positive terminal for first lead line
813 input socket for negative terminal
814 negative terminal for first lead line
820 Second Lead Line Connectors
821 input socket for positive terminal
822 positive terminal for second lead line
823 input socket for negative terminal
824 negative terminal for second lead line
830 Third Lead Line Connectors
831 input socket for positive terminal
832 positive terminal for third line connectors
833 input socket for negative terminal
834 negative terminal for third line connectors
850 On/Off Switch
900 Strip Conductor Lead
902 positive (light color) conductor wire input
904 negative (dark color) conductor wire input
906 protective nonconductive outer layer
908 female receptical end with double recepticals FIG. 1 shows flow chart of a preferred installation process steps of nine steps for installing the novel LED light strips. The steps use the components which are described in FIGS. 2A-12.

Step 1 is to insure the surface for the installation is clean and smooth. Step 2 is to spread white set with a 3/16 "V" notched trowel on the surface of the installation following the manufacturer's instructions then place the tile into the thin set. Step 3 is using approximately 1/8" to approximately 3/16" tile spacers, place them between the tiles where the Light strip will be installed to insure Light Strip will fit tightly between the tiles. In Step 4, After the space is established, use the spacers to scrape the thin set out of the grout joint cleaning it out down to the original surface.

Step 5 is to allow the thin set to dry. Step 6 is to measure the length of the LED (light emitting diodes) Light Strips needed for the area to be lighted. Cut and seal the strips as necessary. Step 6A is used if the application is for using more than one LED Light strip location, use the splitter block to connect these alternate light strips. Step 7 is to plug the Light Strips into the transformer/splitter block to insure all LEDs are still operating after connections have been sealed. Step 8 is using a transparent removable grout that can include GE clear silicone, is to run a thin bead into the bottom of the grout joint, and immediately push the light strip into the grout joint. When dry, complete the second silicone application as detailed in the instructions. Step 9: After the grout seal has dried, grout the tile installation with any non-sanded grout following the manufacturer's instructions.

Figure 2A:
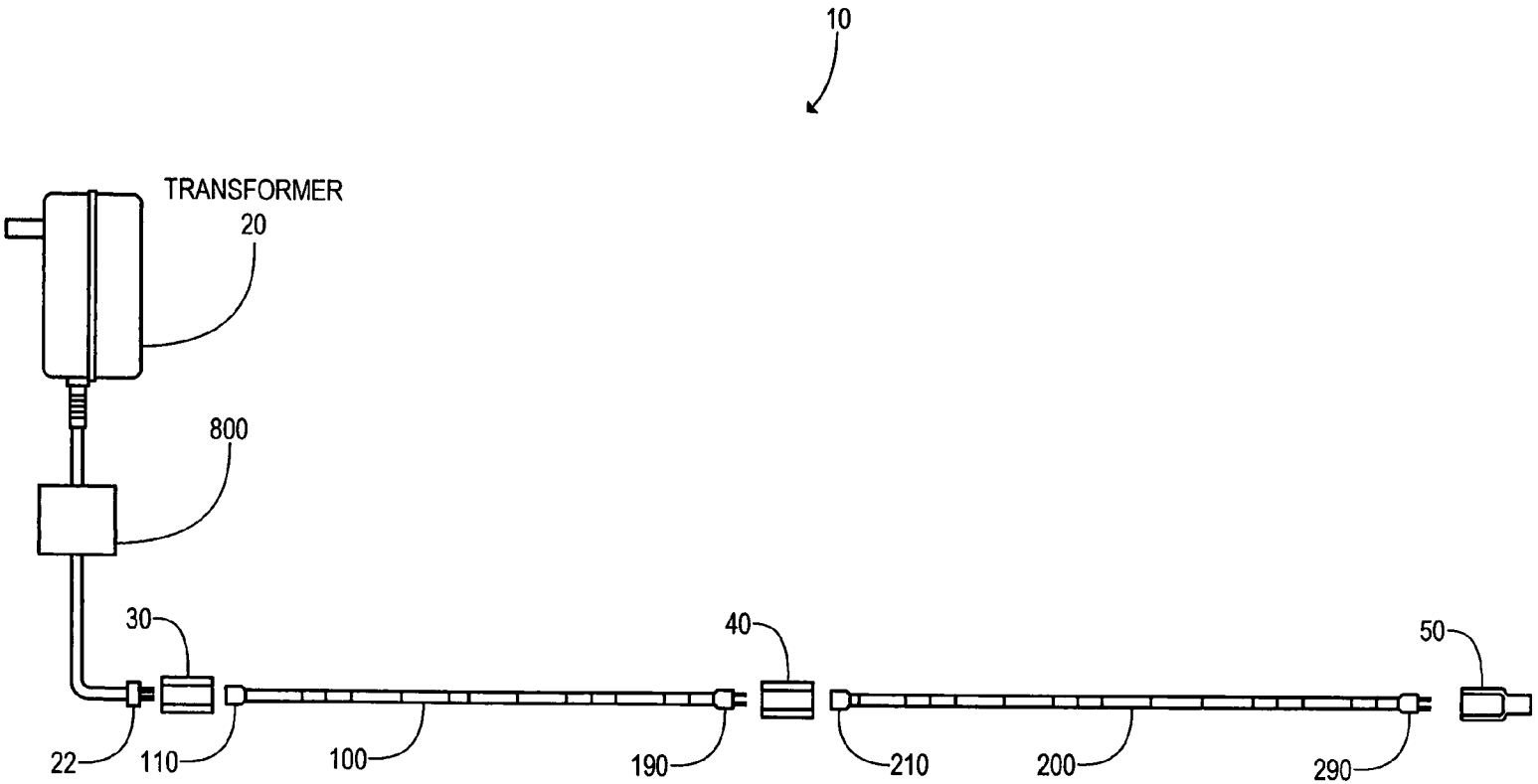
FIG. 2A is an exploded view of a preferred LED-light system configuration of LED light strips with interconnect tubes, end cap,—transformer and splitter block.
Figure 2B:
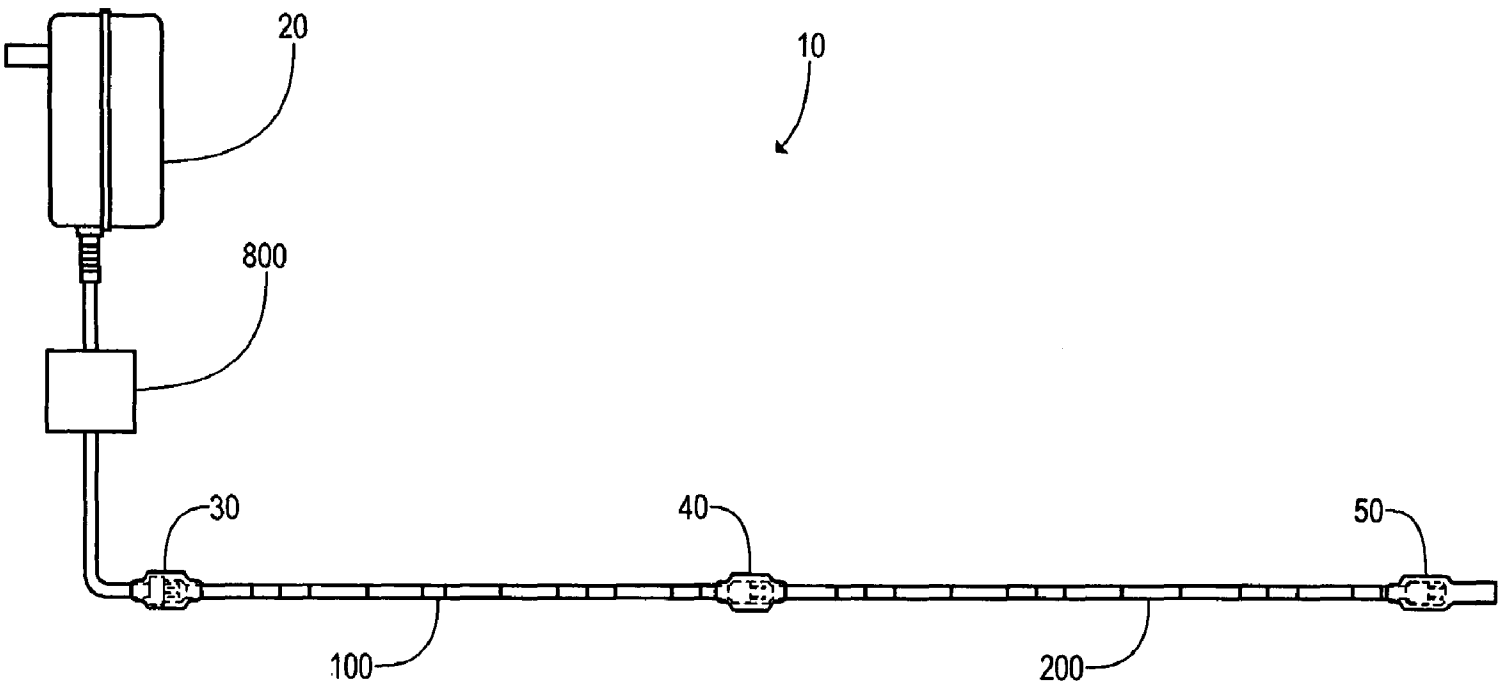
FIG. 2B is another view of the system of FIG. 2A with components interconnected.

FIG. 2A is an exploded view of a preferred LED light system configuration 10 of LED light strips 100, 200 with interconnect tubes 30, 40, end cap 50 and transformer 20. FIG. 2B is another view of the system of FIG. 2A with components interconnected.

Referring to FIGS. 2A-2B, the system can include a transformer 20 that plugs into an existing wall outlet power supply, the transformer 20 supplies power by male prong being connected to a female end of a light strip 100 (or it can be connected through the splitter block, which will be described later in reference to FIGS. 13-19) that contains a plurality of LEDs (light emitting diodes) with a flexible transparent plastic interconnect sleeve 30 covering the connection between. An opposite male prong(s) end of the first light strip 100 can be connected to a female end of a second LED light strip 200 (similar to the first one) with another flexible transparent plastic interconnect sleeve 40 covering the connection therebetween.

Figure 7A:
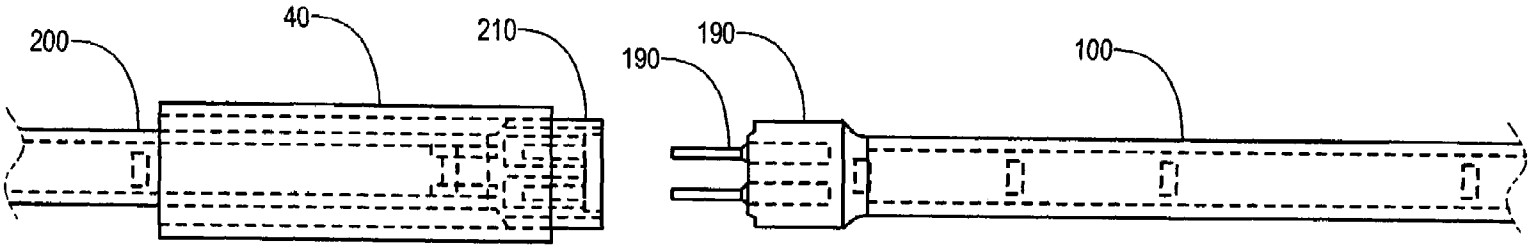
FIG. 7A is an enlarged side view of separated male and female ends of two LED strips.
Figure 7B:
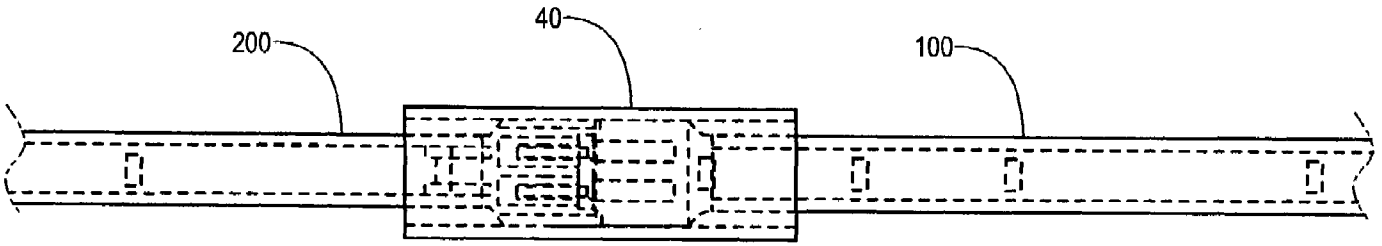
FIG. 7B is another view of the two LED strips of FIG. 7A connected with connection sleeve.
Figure 7C:
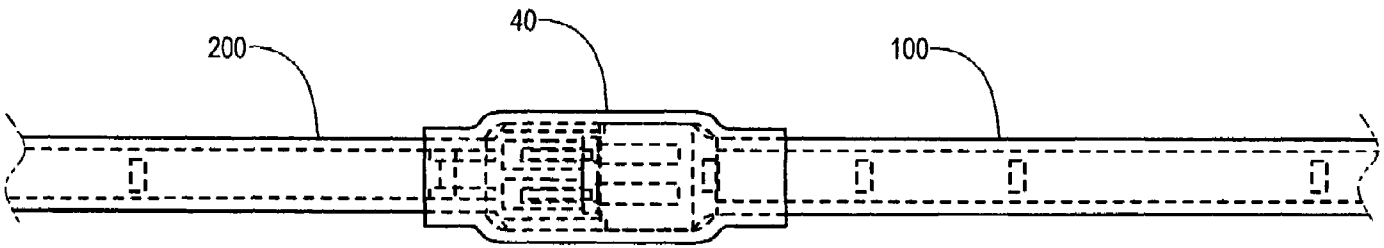
FIG. 7C is another view of the connected LED strips of FIG. 7B with heat shrunk connection sleeve.

Once the interconnect tubes 30, 40 are slid in place over the connected ends of the line connection of transformer male plug end 22 and female receptical end 110 of LED strip 100, and the male prong end 190 of LED strip 100 and female receptical end 210 of LED strip 200, heat from a heat source such as a hair dryer can shrink the interconnect tubes in place. FIGS. 7A-7C show enlarged rear views of one of the connection points.

Referring again to FIGS. 2A-2B, a flexible transparent plastic end cap 50 can protect the exposed male prong end of the second LED light strip 200. Similarly, one the male prong end 290 is inserted into the open end of end cap 50, the heat source can also shrink the end cap 50 in place.

Figure 3:
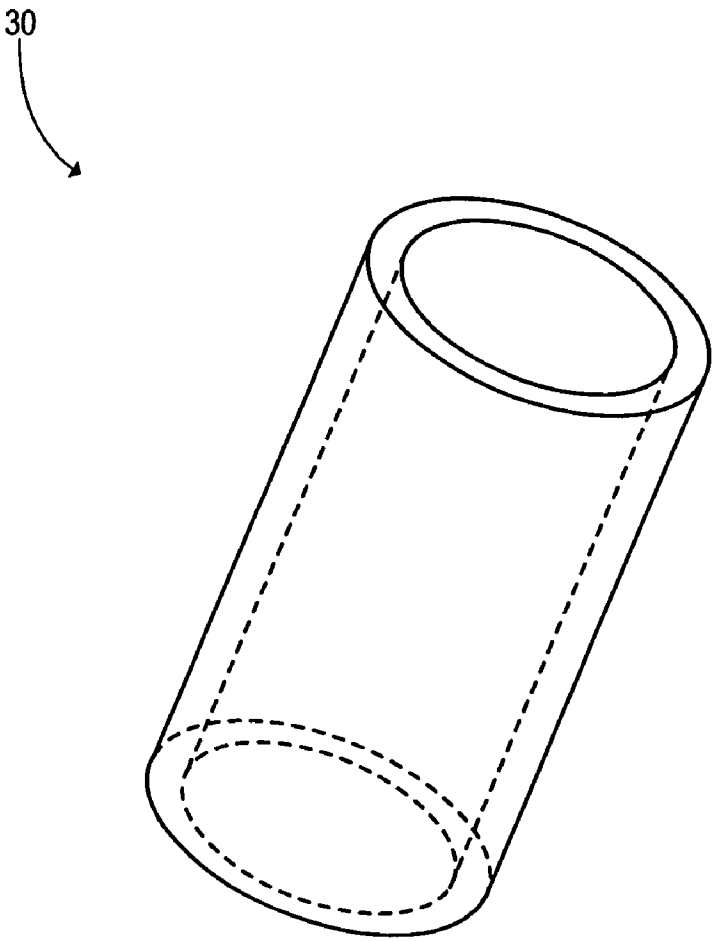
FIG. 3 is an enlarged view of an interconnect tube used with the system of FIGS. 2A-2B.

FIG. 3 is an enlarged view of the interconnect tubes 30, 40 that can be used with the system 10 of FIGS. 2A-2B. Interconnect tubes 30, 40 are transparent plastic flexible sleeves that are sized to fit about the interconnected ends of LED light strips 100, 200 referred to in FIGS. 2A-2B.

Figure 4:
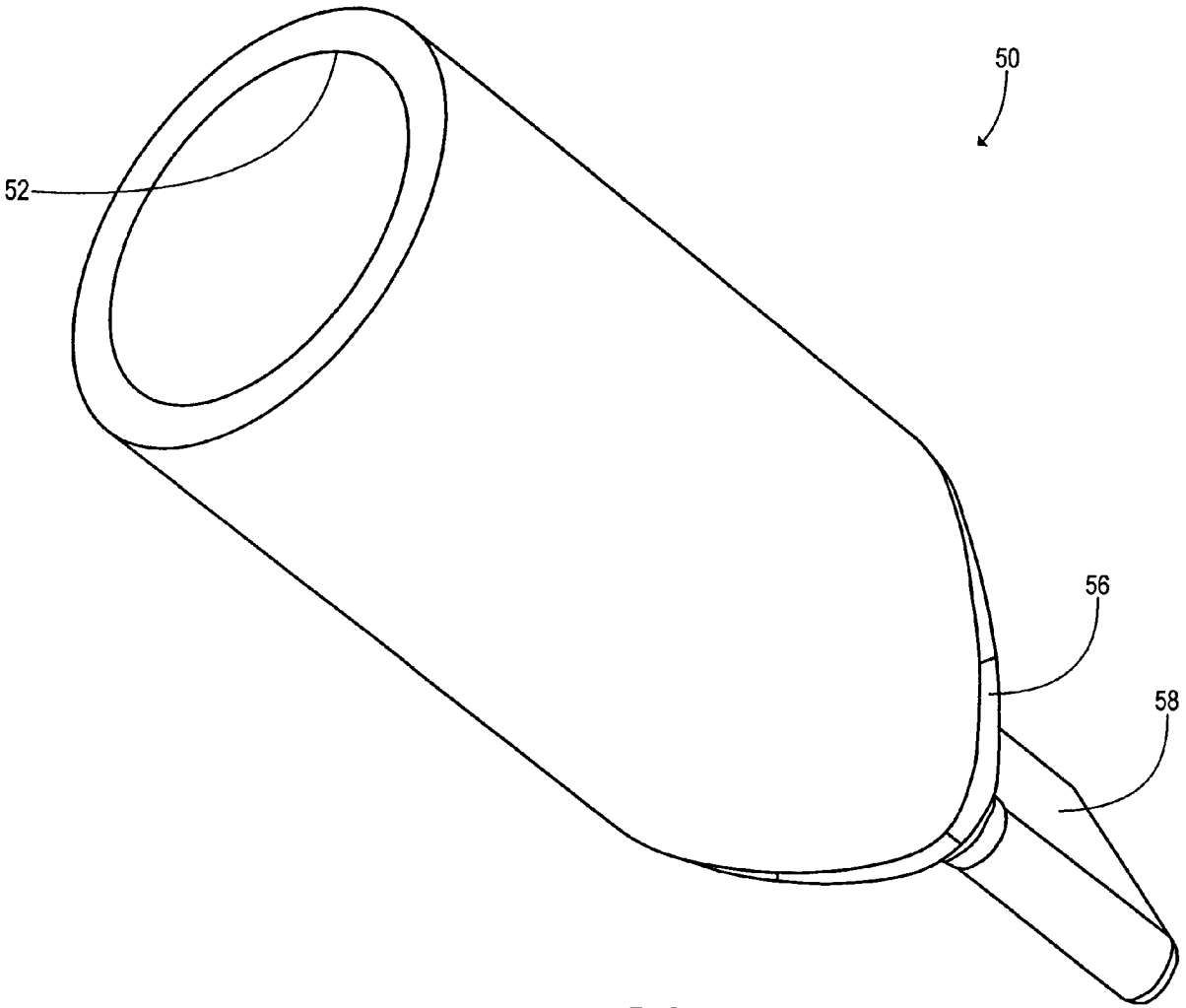
FIG. 4 is an enlarged view of an end cap that is used with the system of FIGS. 2A-2B.

FIG. 4 is an enlarged view of an end cap that is used with the system of FIGS. 2A-2B. End cap 50 can be a transparent plastic flexible cap shape having an open end 52 and a closed curved/domed shape end 56 with a handle portion 58 extending out from the closed end.

Figure 5:
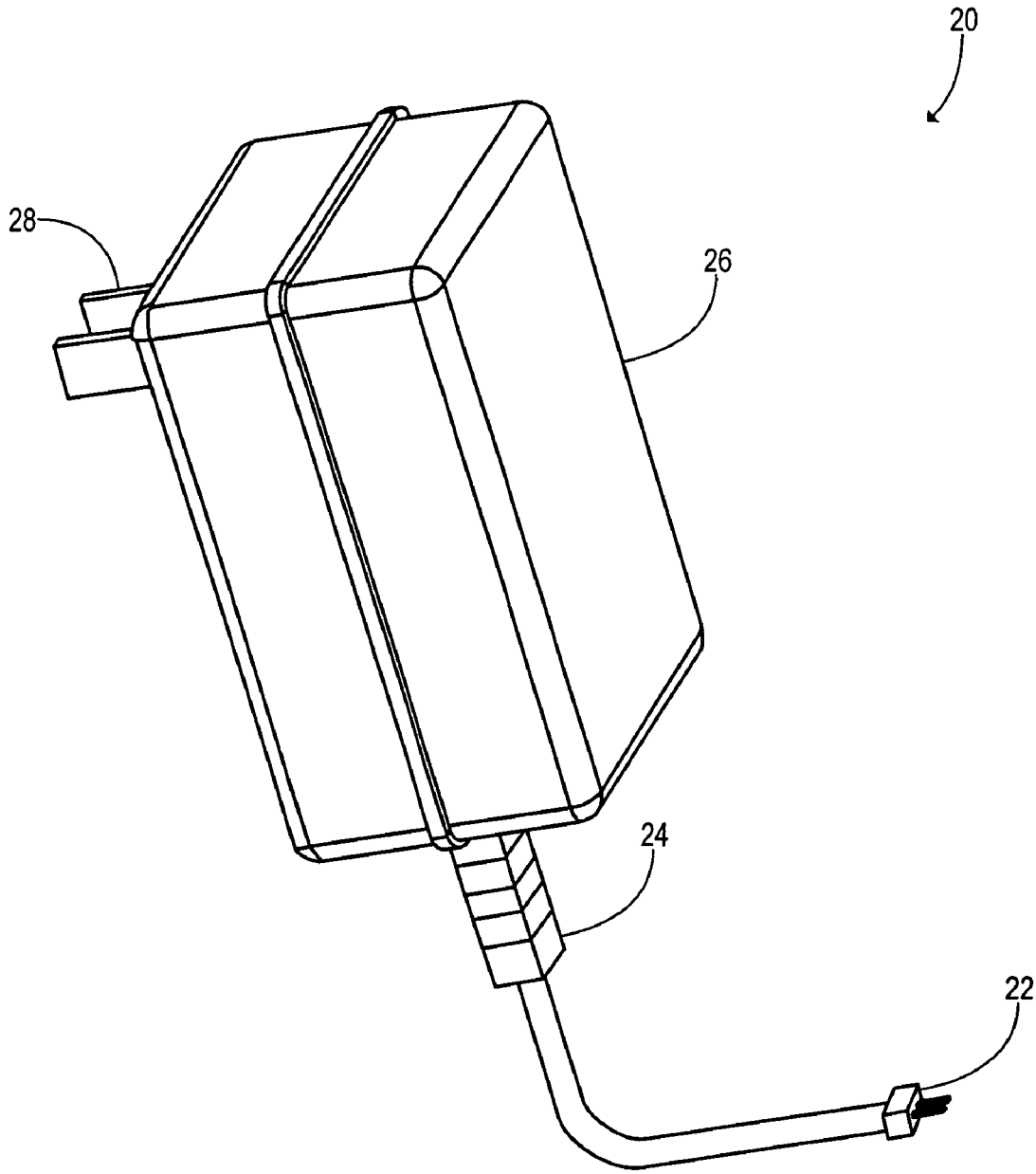
FIG. 5 is an enlarged view of a transformer that is used with the system of FIGS. 2A-2B.

FIG. 5 is an enlarged view of a transformer 20 that can be used with the system of FIGS. 2A-2B. Transformer 20 can include a male prong end 22 that can connect to a female receptical end of the LED light strips 100, 200. Transformer 20 can have an enlarged end 24 that fits into the main housing 26, and a power plug 28 allows the transformer 20 to connect to 120 volt household power sources. A preferred embodiment of the transformer 20 is the ability to drive up to approximately 20 LED strips, with a preferred size of 12V DC 4.5 Amp capability. This size transformer can be used with the splitter application shown in FIGS. 13-19 as well. Different sized transformer can also be used in different applications.

Figure 6A:
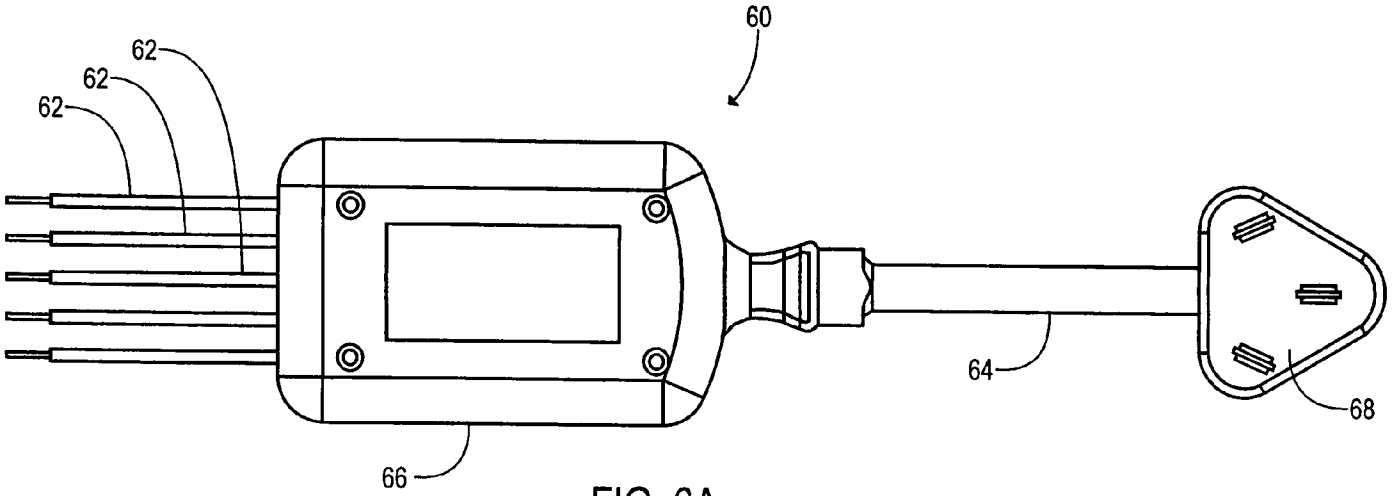
FIG. 6A is a top view of an alternative transformer that can be used with the system of FIGS. 2A-2B.
Figure 6B:
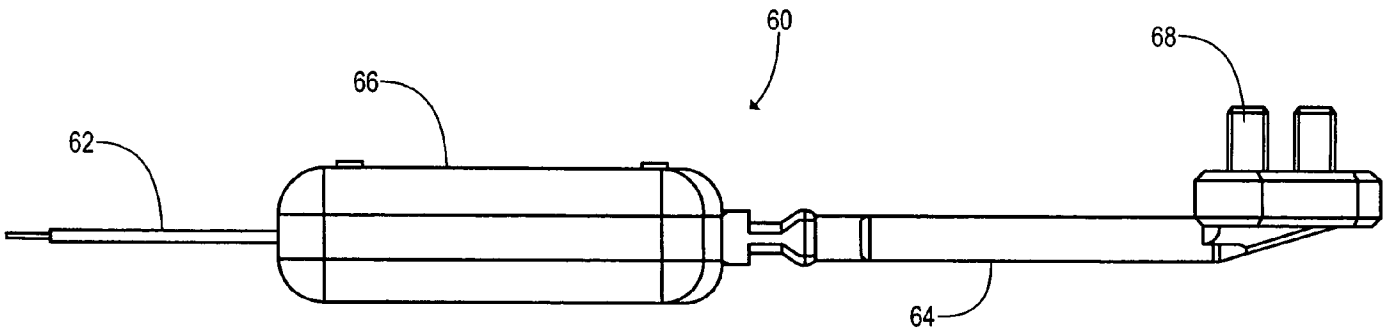
FIG. 6B is a side view of the alternative transformer of FIG. 6A.

FIG. 6A is a top view of an alternative transformer 60 that can be used with the system 10 of FIGS. 2A-2B. FIG. 6B is a side view of the alternative transformer 60 of FIG. 6A. Transformer 60 can have plural male prong lines 62 that can allow the transformer to simultaneously connect to several LED light strips 100, 200, or more at one time. The male prong lines 62 can connect to main housing 66 and have a power line 64 leading off the main housing 66 which has a plug end 68 that can have three prongs for allowing the transformer to plug into three slot and grounded power receptical outlets.

FIG. 7A is an enlarged side view of separated male and female ends of two LED strips 100 and 200 shown in FIG. 2A. FIG. 7B is another view of the two LED strips 100, 200 of FIG. 7A connected with connection sleeve 40. FIG. 7C is another view of the connected LED strips 100, 200, of FIG. 7B and FIG. 2B with heat shrunk connection sleeve 40.

A preferred embodiment of an LED strip 100 or 200 can have 33 LEDs (light emitting diodes) that when operated will consume approximately 2.4 Watts. The height of an individual strip can be approximately 5 mm (approximately 0.20 inches) with a width of approximately 3.5 mm (approximately 0.14 inches). One preferred embodiment can have dimensions of approximately 4 mm by approximately 5 mm and have an overall length of approximately 21 inches, preferably 20.7 inches (approximately 526 mm).

Each LED can be placed approximately 1.25 inches apart from one another on one side and approximately 0.625 inches apart on both sides. Individual LEDs can be soldered to a pair of conductive copper strips (one positive and one negative) that run through the transparent housing sleeve of the strips. Each LED soldered to both positive and negative conductive strips.

The elongated strips can have a flexible transparent plastic housing/sleeve that is bendable up to approximately 45 degrees and each strip has a height of approximately 0.20 inches and a width of approximately 0.14 inches.

Figure 8B:
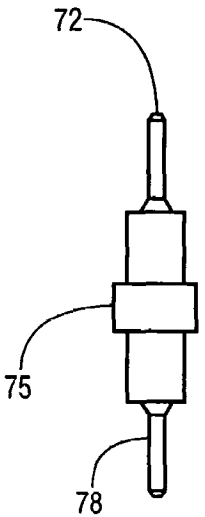
FIG. 8B is a side view of the interconnector of FIG. 8A.
Figure 8A:
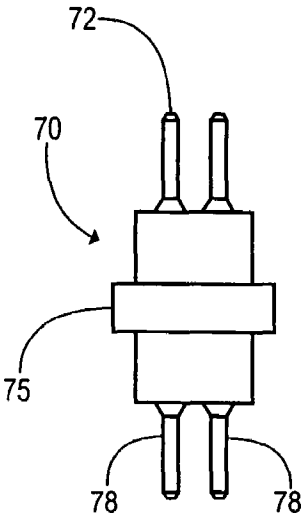
FIG. 8A is a top view of an alternative interconnector for the LED strips.
Figure 8C:
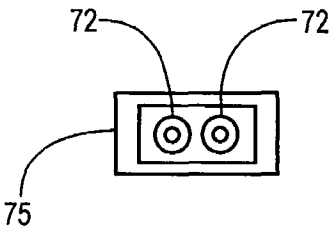
FIG. 8C is an end view of the interconnector of FIG. 8A.

FIG. 8A is a top view of an alternative interconnector 70 for the LED strips 100, 200 described above. FIG. 8B is a side view of the interconnector 70 of FIG. 8A. FIG. 8C is an end view of the interconnector of FIG. 8A. Referring to FIGS. 8A-8C, the alternative interconnector 70 can have top male prong ends 72 and bottom male prong ends 78 with an enlarged midsection therebetween.

Figure 9:
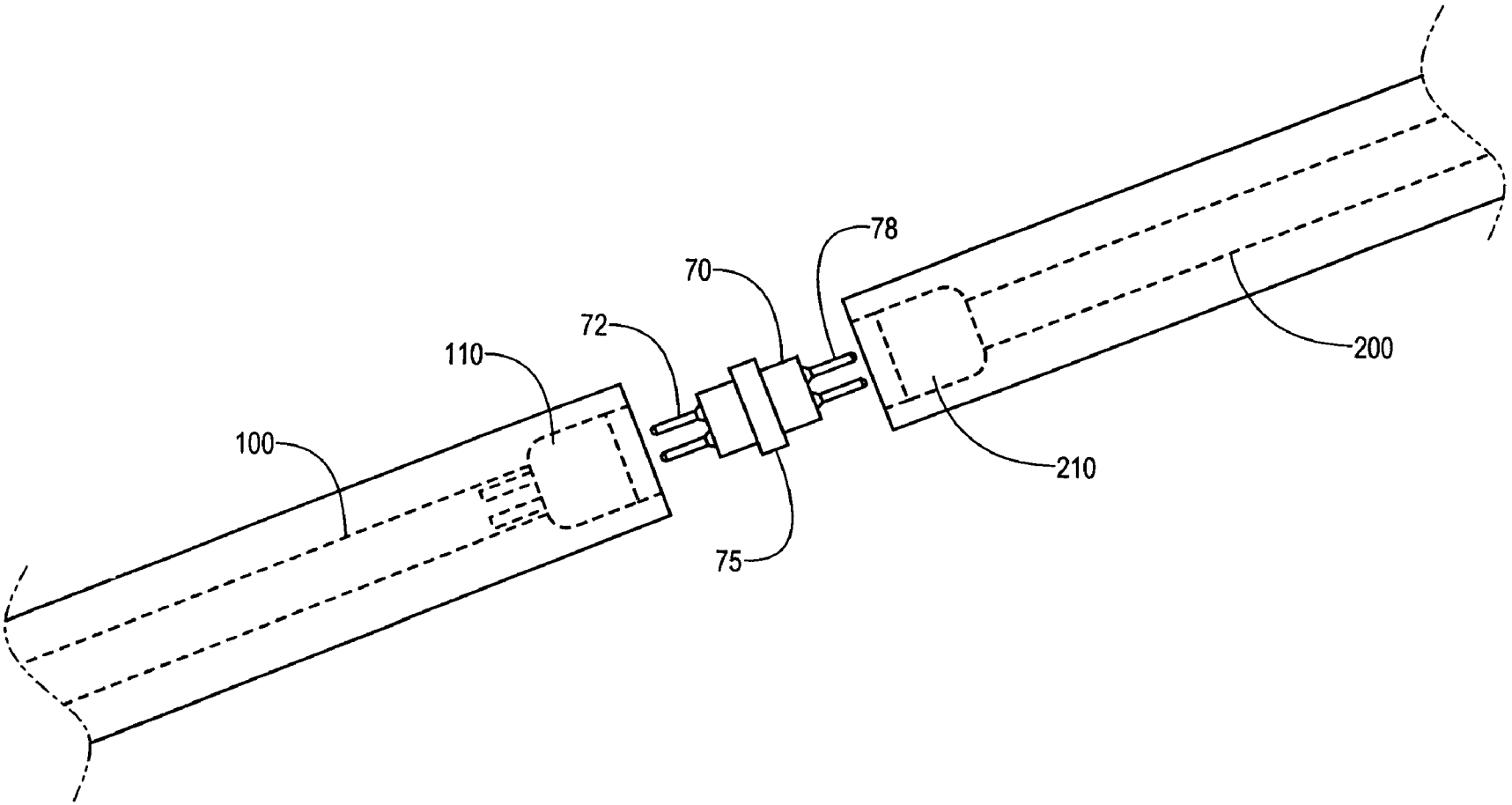
FIG. 9 is a side view of the interconnector of FIGS. 8A-8C being attached to both ends of two LED strips that are about to be attached to one another.

FIG. 9 is a side view of the alternative interconnector 70 of FIGS. 8A-8C being attached to both female receptical ends 110, 210 of two LED strips 100, 200 that are about to be attached to one another.

Figure 10:
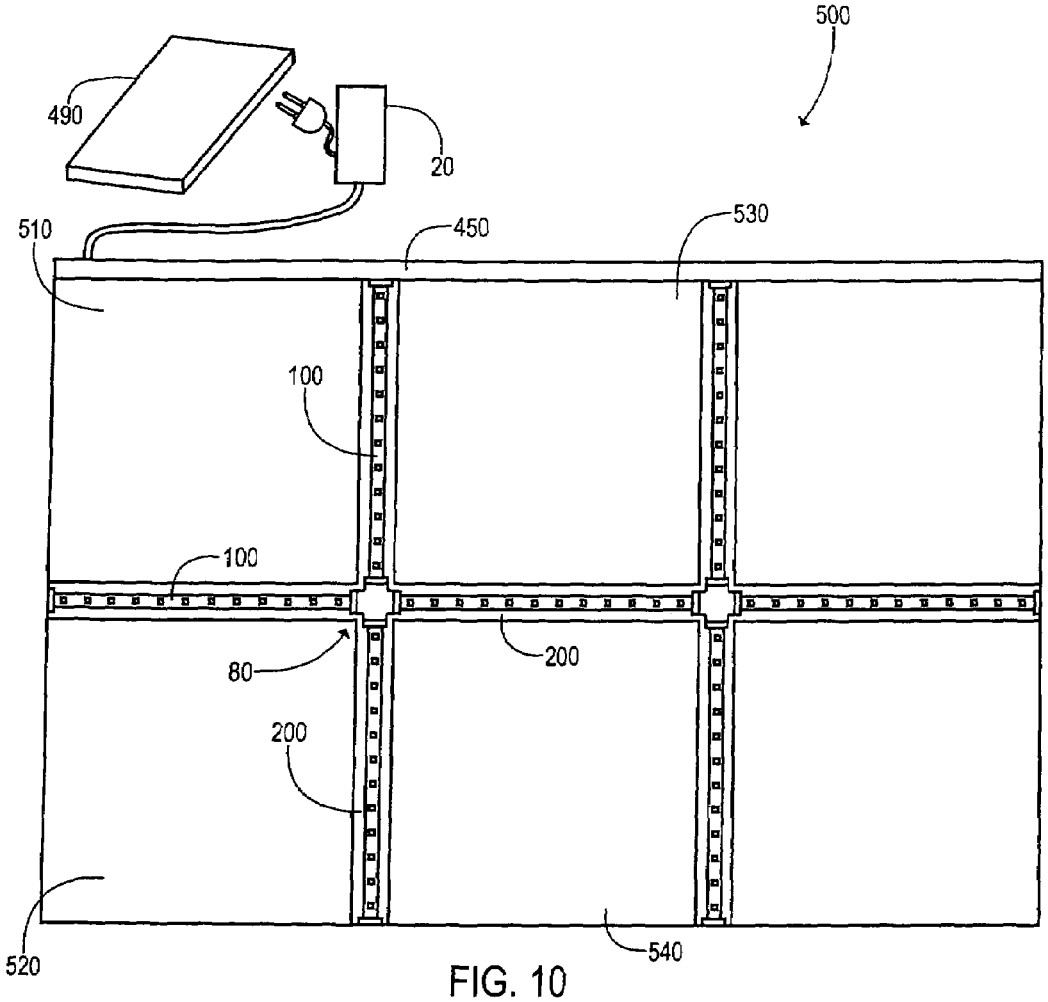
FIG. 10 shows a layout of LED strips located in the joint spacings between glass tiles.
Figure 10A:
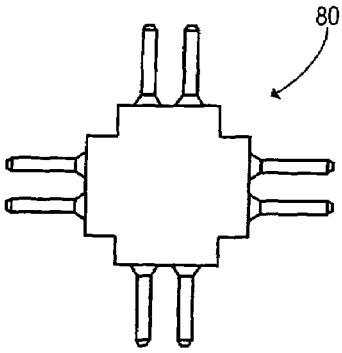
FIG. 10A is an enlarged view of an alternative strip connector, cross shape with four prong ends.

FIG. 10 shows a layout application 500 of LED strips 100, 200 located in the joint spacings between glass tiles 510, 520, 530, 540 over a base surface 400. FIG. 10A is an enlarged view of an alternative strip connector 80 having a cross shape with four prong ends that can connect to female receptical ends of up to four LED light strips at one location. The tiles 510, 520, 530, 540 can be glass tiles, combinations of glass tiles and other tiles, such as but not limited to ceramic tiles and stone tiles, and the like. A power control base such as an extension power cord can be used to connect the LED strips 100, 200 to a power transformer 20, 60, and the like, that can connect to household power supply sources and/or to other power sources such as but not limited to solar power 490 and the like. The invention can use a power/control base board device that either draws its supply energy from the building electrical grid or from and alternate power source, such as battery, solar, wind or any combination of these power sources.

Figure 11:
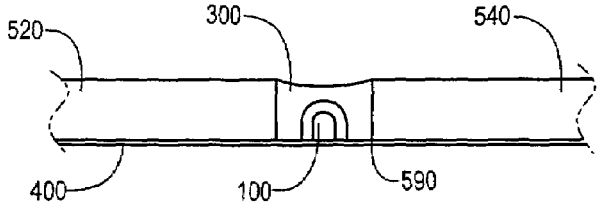
FIG. 11 is a side cross-sectional view of one of the installed LED strips in the joint spacing between two tiles of FIG. 10.

FIG. 11 is a side cross-sectional view of one of the installed LED strip 100 in the joint spacing 590 between two tiles 520, 540 of FIG. 10 with transparent grout such as clear silicon around the sides and top of the strip. Clear grout can be placed underneath the LED strips 100 on the mounting surface 400 and/or a removable backing 710 (FIG. 12) can expose an adhesive backing 715 that allows the LED strips to be attached directly to the mounting surface 400.

The joint spacing 590 between the tiles is preferably uniform and approximately 3/16 of an inch in width. The flexible plastic housings that surround the LED strips 100, 200 can be optimally positioned approximately 3 to approximately 4 mm below top surfaces of the tiles.

Figure 12:
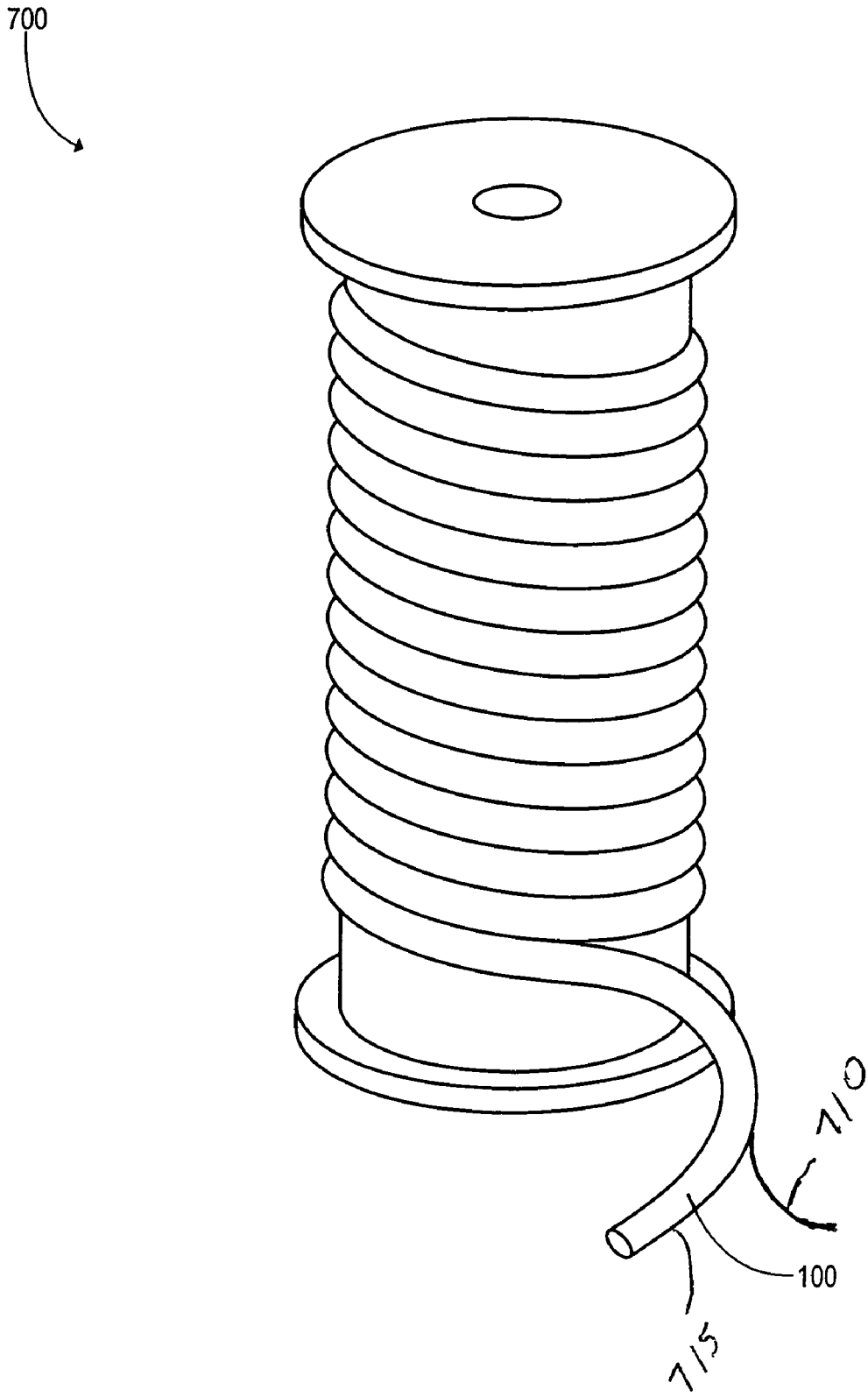
FIG. 12 shows a roll of the LED strips with removable adhesive covered backing layers.

FIG. 12 shows a roll 700 of the LED strips 100/200 with removable adhesive covered backing layers 710 that when removed expose adhesive backing surfaces 715. The system can have the LED strips purchased separate as either a pre-measured length or strip or sold in a roll 700 that can be cut and connected together using quick connectors.

Applications of the glass tile lighting system and method of installation can be used in a combination of glass tiles. The invention can be used indoors or outdoors, in kitchens and bathrooms or any place where glass tiles or tradition tiles are used.

The lighting system and method of installation can be used with glass tiles, of a plurality of sizes and shapes as well as glass tiles together with tiles using a different material such as but not limited to ceramic or stone.

The lighting source, such as single LED's, can be arranged in a strip that is flexible or inflexible, that can be connected together with a quick connect system. The LED lighting system can be made up of LED's that can be either monochromatic in a plurality of colors that range across the color spectrum or an LED capable of producing the full color spectrum or any part of the color spectrum. In addition the LED strip can be any color currently manufactured by the LED industry including those LED's that can change color through the entire color spectrum.

The lighting system and method of installation can also use non-LED light sources, such as Electro-luminescence (EL) or organic LED's (OLED) or fiber optics in conjunction with a power/control system and the clear silicone or transparent grout.

The LED lighting system can have a power control system that allow the LED's to be pulsed or dimmed at will by the owner using preset controls or combined with a music sound system to pulse the light to the beat of music.

With the removable silicone or transparent grout, the LED strips are replaceable. The LED strips can be placed in between the tiles throughout the tile that will give a nice light effect, that can be placed at will on corners or horizontal and vertical grout lines in multiple directions through the glass tile.

The invention system of installation can be used with any glass tiles that are currently on the market. In fact this LED strip is so unique it can be used with any combination of glass tiles and regular ceramic or stone tiles, because the light can be-allowed to shine straight out from the tile surface by the use of the clear silicone or transparent grout. So this system can be used with standard ceramic and stone tiles.

The LED strips are interchangeable and replaceable because the clear silicone or transparent grout is removable. The LED strip can be used on any size tile and on any thickness tile as long as it is over −6 mm minimum safety standpoint. The strips have set current and wattage restrictions and must be properly matched with a power source to give the LED's long life. As described above, the LED strips can come in rolls or single strips. The strips can be made into any shape or a plurality of shapes. They can be located under the tile or located at the sides of the tile. The strips can be used indoors or outdoors as well as in bathrooms, kitchens, bedrooms.

The LED strips can be incased in a plastic material that is resistant to damage from the sun or exposure to harsh cleaning chemical or any typically marketed tile and-glass cleaners. The plastic will be sufficiently fire retardant to meet all UL guidelines governing LED lighting. The plastic material will protect the LED from all forms of moisture and corrosion for all outdoor applications as well as when the initial clear silicone or transparent grout is applied.

Various types of installation methods will now be described.

Joint and End Cap Sealing Instructions

Connect the LED Light Strip to the Power Source insuring the + and − connections are matched correctly (+ to + and − to −), connecting all together to the Transformer power source to confirm all LEDs are working. Slide the sealing connector over the joint and heat it with a —Hair dryer or other blower heat source to observe the plastic sleeve shrinking around light strip. (1) The sleeve has been shrunk correctly when there is no movement at the connection. If the installer observe any movement, push the connection together and apply more heat all around the sleeve to insure the connection is tight. This same method is used between each connection of light strips. Place the end cap protective sleeve at the end of the light strip and apply heat as described above. After all of the connections are made plug in the light strips to insure all lights are still working. When this is done the installer can proceed with the installation of the light strip into the tile grout joint making sure that the LEDs are facing the edges of the tile.

—Never use a match or lighter to shrink the plastic sleeve or end cap. When using a blower type heat source or hair dryer caution should be used as the plastic sleeve will become hot to the touch so do not touch it for one a minimum of one (1) minute after the seal shrinks to the light strip.

Retrofit and Repair Instructions

Retro

It is possible to use the Light Strip on Glass Tile that has already been installed. There are two (2) basic qualifications for this to be accomplished. First the grout joint where you want the light strip installed must be $3/16^{th}$ of an inch wide, and the tile must be a minimum of 6 mm thick Any narrower and the strip will not fit into the joint, and any thinner and the LED light strip will protrude above the surface of the tile.—If these two qualifications are met the light strip can be installed into an existing glass tile job.

The grout in the joint will have to be removed using a grout saw. Care must be taken to insure the edges of the glass tile are not chipped or cracked. When the joint is "totally cleaned" down to the surface of the wall the installer can proceed with the "Installation Instructions."

Repair

In the event that the LED light strip has to be replaced use the following instructions to complete the replacement. Using a grout saw remove the grout down to the existing light strip being careful not to chip or crack any of the tiles. When the grout is removed use a utility knife and gently run the blade along both edges of the tile on either side of the light strip. Grasp the end of the light strip with needle nose pliers and gently pull the light strip up and out of the grout joint. When the light strip has been removed, thoroughly clean out the grout joint with the grout saw removing all GE Silicone and grout residue. When the grout joint is clean install the new light strips using the "Installation Instructions."

LED Light Strip

Installation Instructions

Insure that the surface for the installation is clean and smooth. Following the Manufacturer instructions using a $3/16^{th}$ V-Notched trowel spread the thin set onto the area where the Tile is to be installed.

Place the tile into the thin set pressing it down to insure that all of the tiles are flat and at the same level on the surface. In the grout joint where the Light Strip is to be installed use 3/16" tile spacer to insure the grout joint is at the proper width so that the Light Strip fits tightly into the grout joint. If the joint is too small the Light Strip will not fit and if it is too wide there is a danger that the LEDs will not shine directly into the edge of the tile.

After the spacing is correct, and before the thin set dries, use the spacers to scrape the thin set out of the grout joint down to the original surface. Be sure that there is NO thin set in the grout joint or the light strip will not light the tile properly and will, in fact, stick up above the surface of the tile.

Allow the thin set to dry properly.

Measure the length of the light strip needed for the area to be lit then cut at the designated point. Plug all of the strips together and into the power source to insure all lights are working. When this is confirmed you can now seal all of the connections, following the directions in the Light Strip Package. After this is done plug the light strip into the transformer power source again, to insure all LEDs are working after you have completed sealing each Light Strip joint.

Using GE Clear Silicone, run a thin bead into the bottom of the grout joint. This should be a very thin bead, just enough to hold the light strip in place. Push the light strip into the silicone vertically so the LEDs are facing the edges of the tile, forcing it down to the original surface. The light strip should now be about 2 to about 4 mM below the surface of the tile depending on the thickness of the tile. After the silicone has dried (see the timing on the GE Silicone package) apply another application of the GE Clear Silicone so that it is forced between the LED light strip and the edges of the tile and comes just to the top of the LED light strip, leaving room for the grout application. This application insures that no grout will come between the LED light source and the edge of the glass tile. After this second application is dry you can complete the installation by grouting all of the tile joints.

Follow the manufacturer instructions using an approved grout float and un-sanded grout. Other tools needed would be a grout sponge and clean rags to polish the surface of the tile. Allow the grout to dry before operating the lights. The small amount of heat put off by the LEDs may be enough to dry the grout in the light joint faster than the other joints giving the grout a different color appearance.

LED Light Strip

Alternate Installations and Uses

The Tile Light LED Light Strip is primarily designed to light Glass Tile installations by applying the strip of LED lights into the grout joint of a Glass Tile Installation.

The Design of the Light Strip also opens up several other lighting opportunities: Glass shelving can be illuminated by applying the light strip to the edge of the shelf that would show a warm glow to the edges of the shelf. This application can be accomplished by a simple tape application or an extruded plastic "C" channel that slides onto the shelf edge. It can be powered with an AC Transformer or battery operated. The light strip for this application can be either a single sided LED strip or the current dual sided light strip, depending on the desired look.

Decorative glass mirrors can be lighted in the same manner as the shelving. This can be accomplished using the same installation methods and power supplies.

Glass block installations can easily be lighted using the light strips. They can easily be Silicone glued to the edge of the blocks and installed per the manufactures directions allowing the block to be lighted without the necessity of drilling holes in the block as is the only alternative method currently.

The design of the light strip can be modified to be installed into the base of decorative glass home décor (vases, figurines, accent pieces, inside/outside of Picture frames, etc) to light them as they are displayed in the home.

The LED light strips can be packaged in containers having packaging information as follows.

LED Light Strip

Packaging Information

Packaging of the LED Light Strips will be as follows:

1. The transformer will be packaged as an individual item and include all installation instructions and two (2) Joint Sleeves.
2. The LED Light Strips will be packaged one to a blister pack with all installation instructions including two Joint Sleeves and two (2) End Cap Sleeves.

Splitter Application

Figure 13:
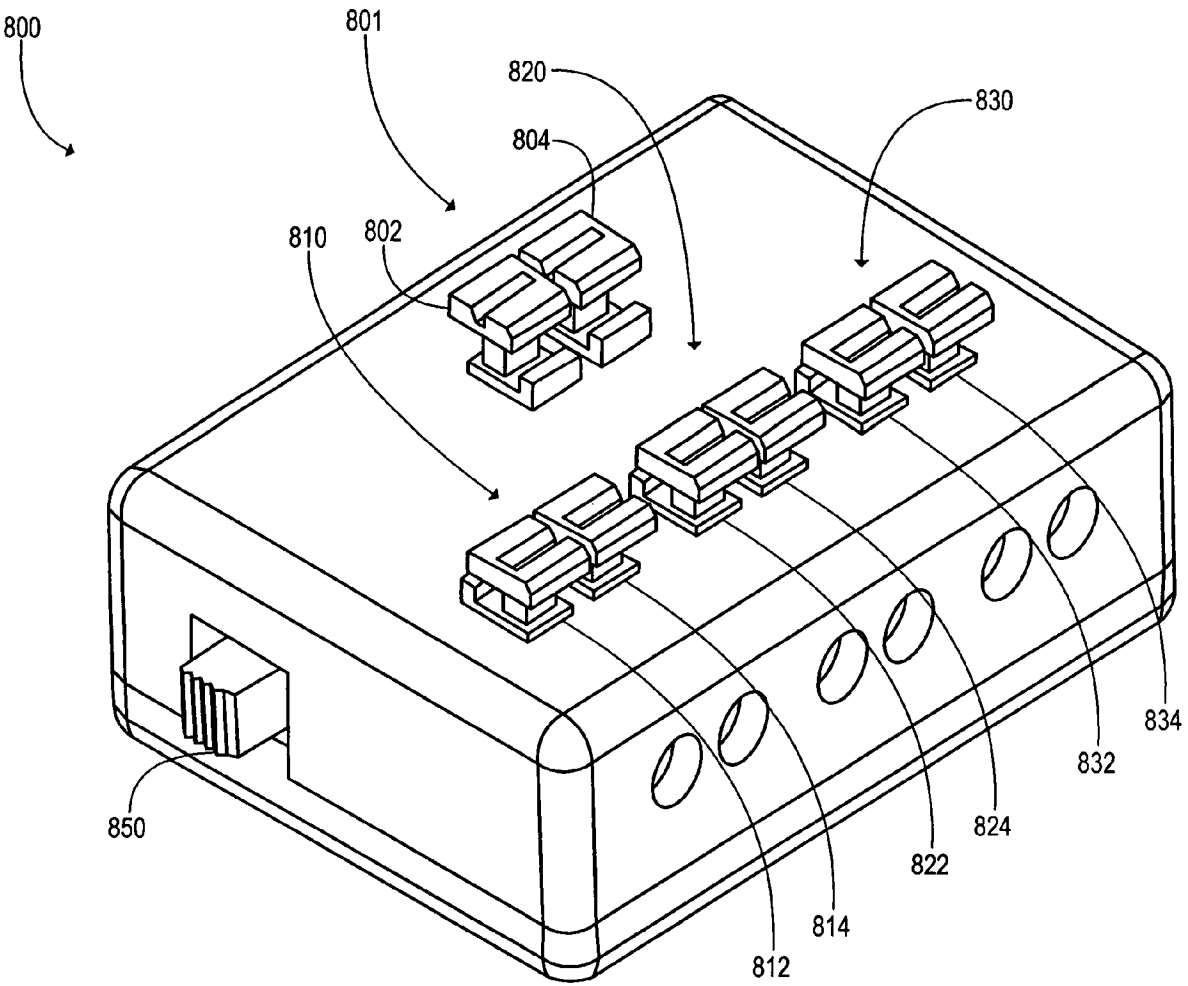
FIG. 13 is perspective view of the splitter block that allows for multiple leads to LED light strips, and this Splitter also has an on/off switch.
Figure 14:
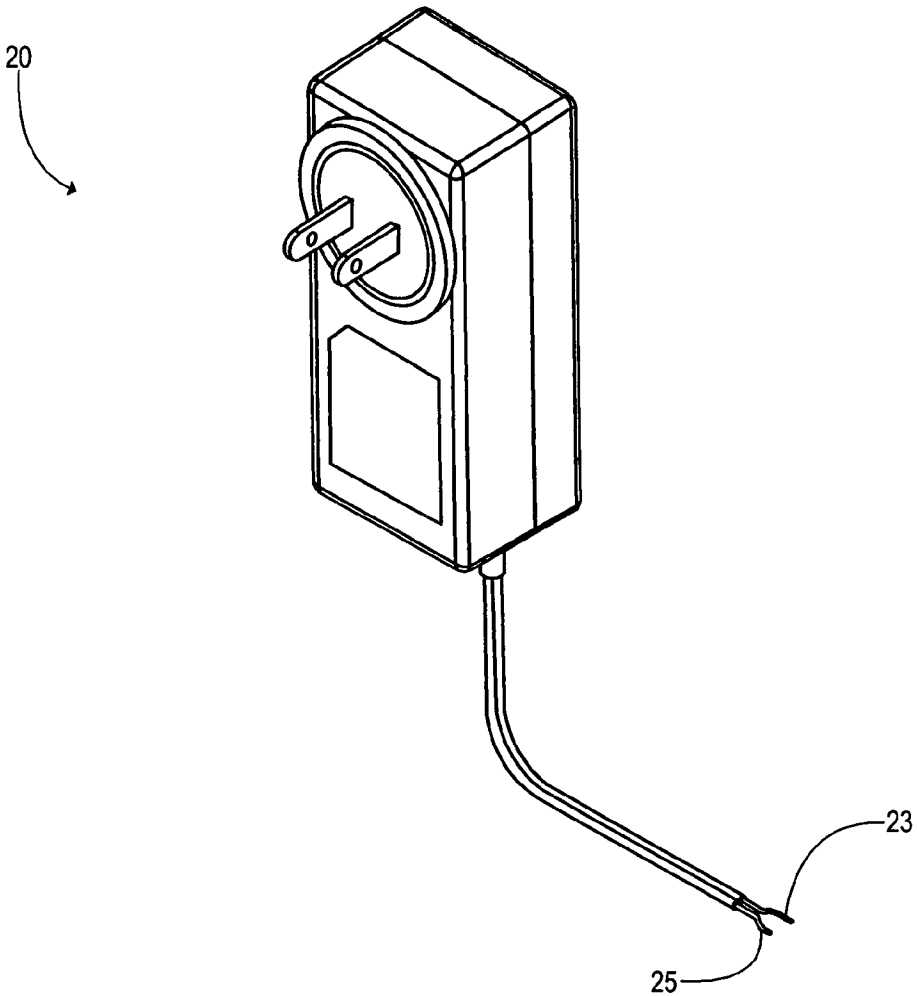
FIG. 14 is another perspective view of the transformer with the transformer wire feed lines exposed.
Figure 15:
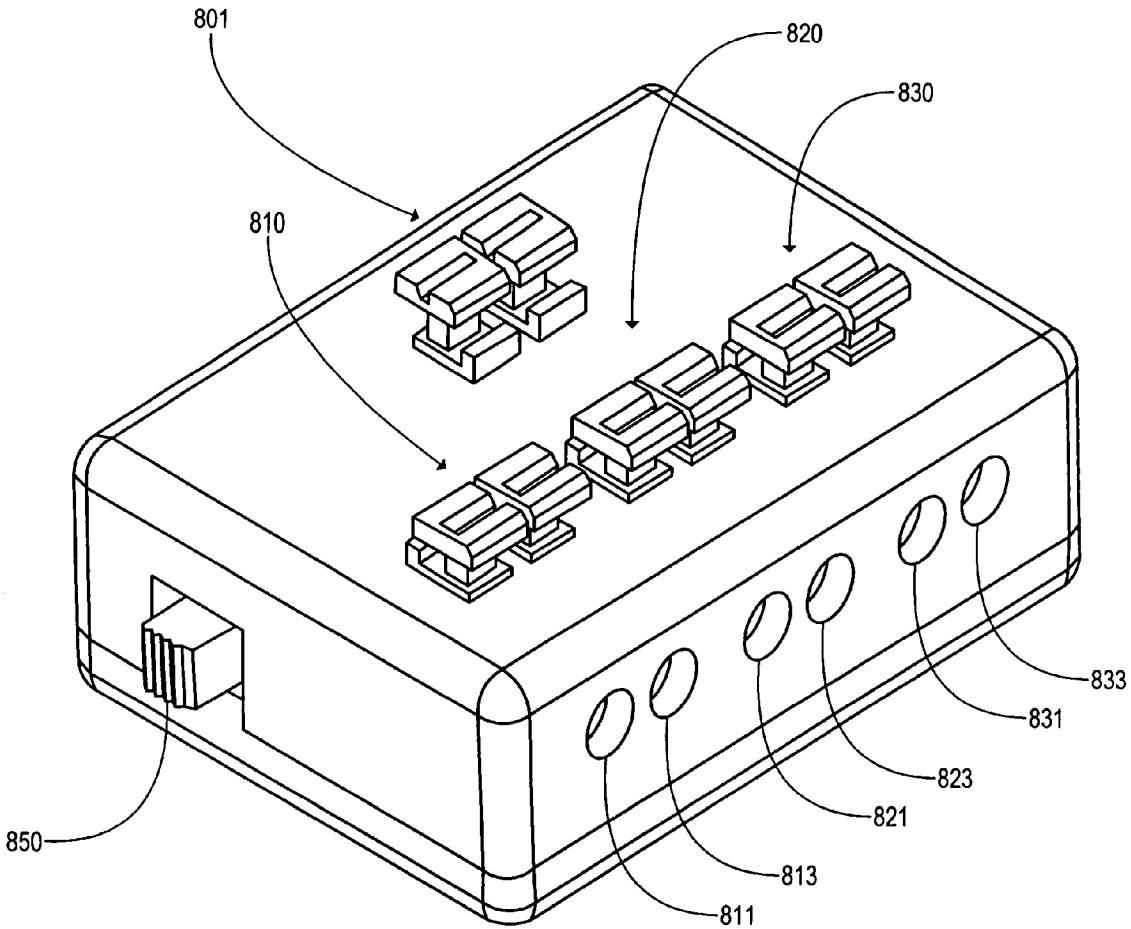
FIG. 15 is another perspective view of the splitter block of FIG. 13.

FIG. 13 is perspective view of the splitter block 800 that allows for multiple leads to LED light strips 100A, 100B, 100C, and this Splitter 800 also has an on/off switch 850. FIG. 14 is another perspective view of the transformer 20 with the transformer wire positive feed line 23 and negative feed line 25 exposed. FIG. 15 is another perspective view of the splitter block 800 of FIG. 13.

Figure 16:
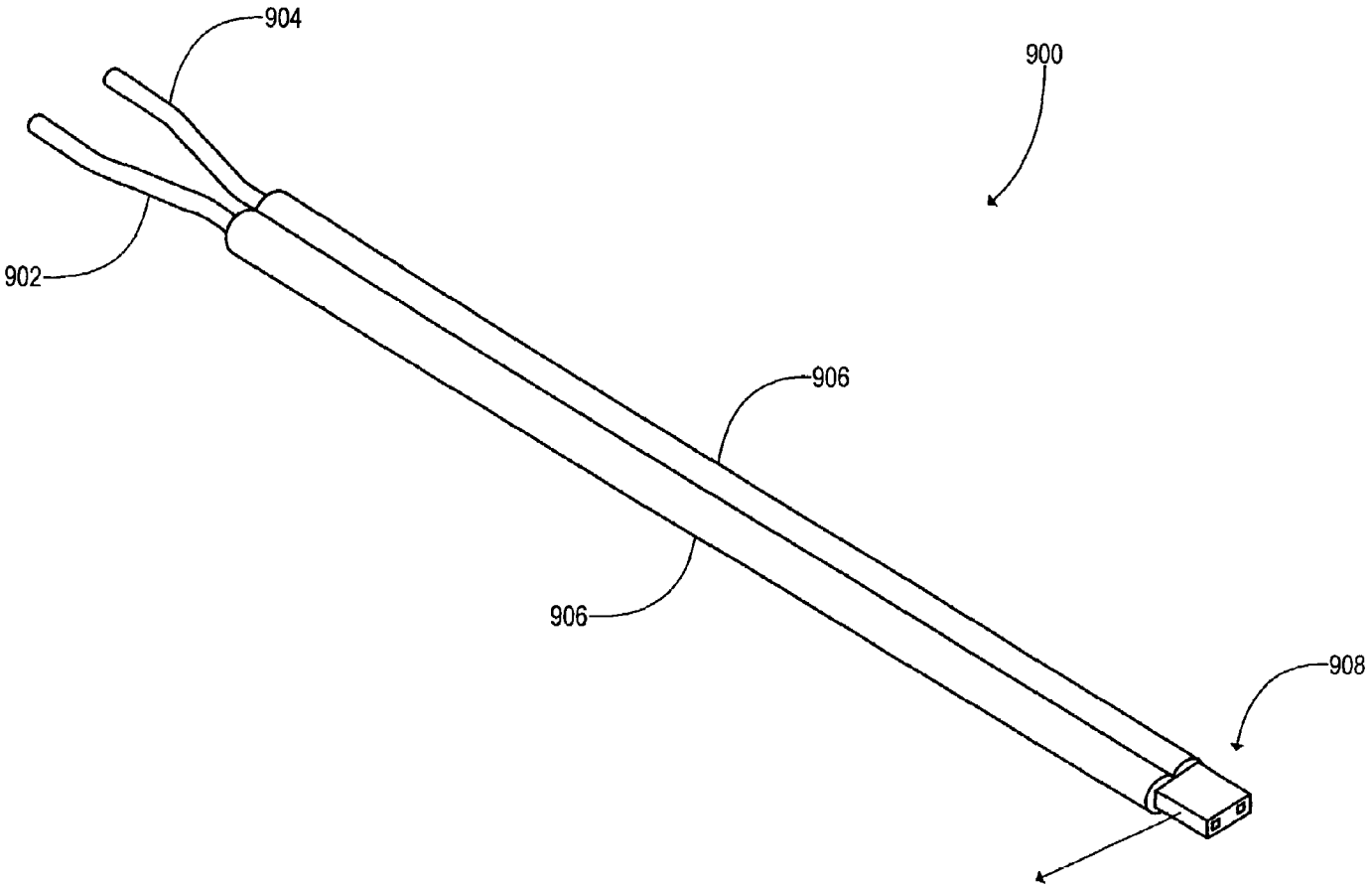
FIG. 16 is an enlarged view of one of the connecting lines that can be used with the splitter.
Figure 17:
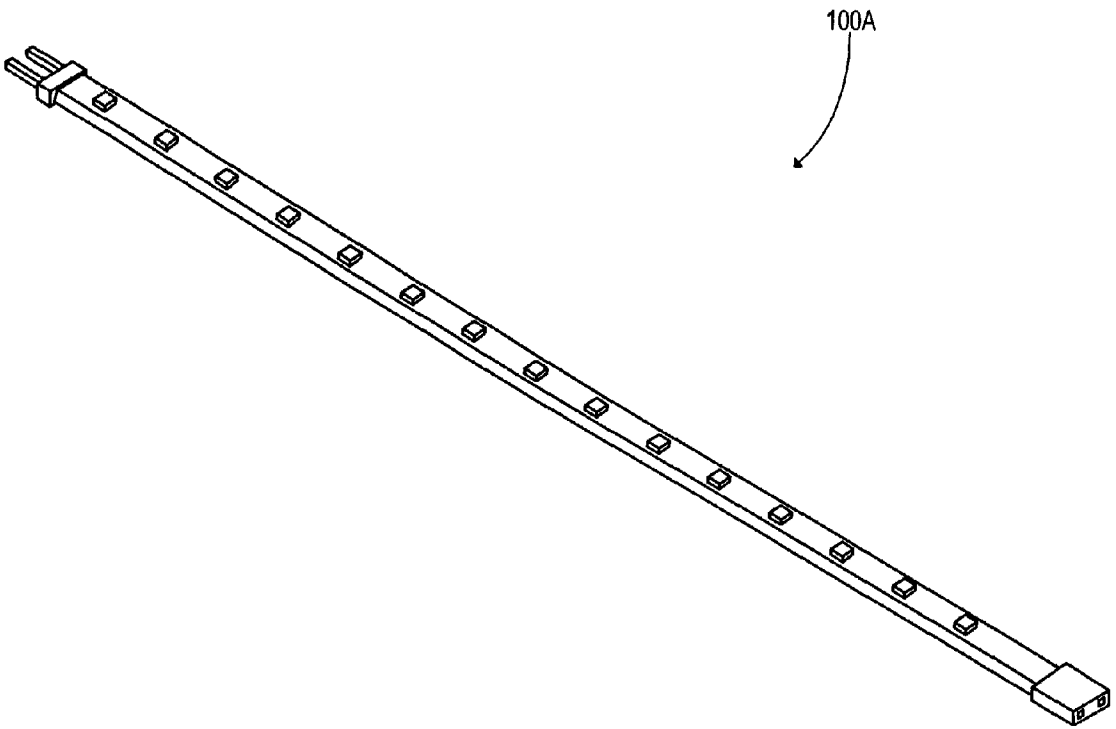
FIG. 17 is another view of an LED strip for use with the splitter.
Figure 18:
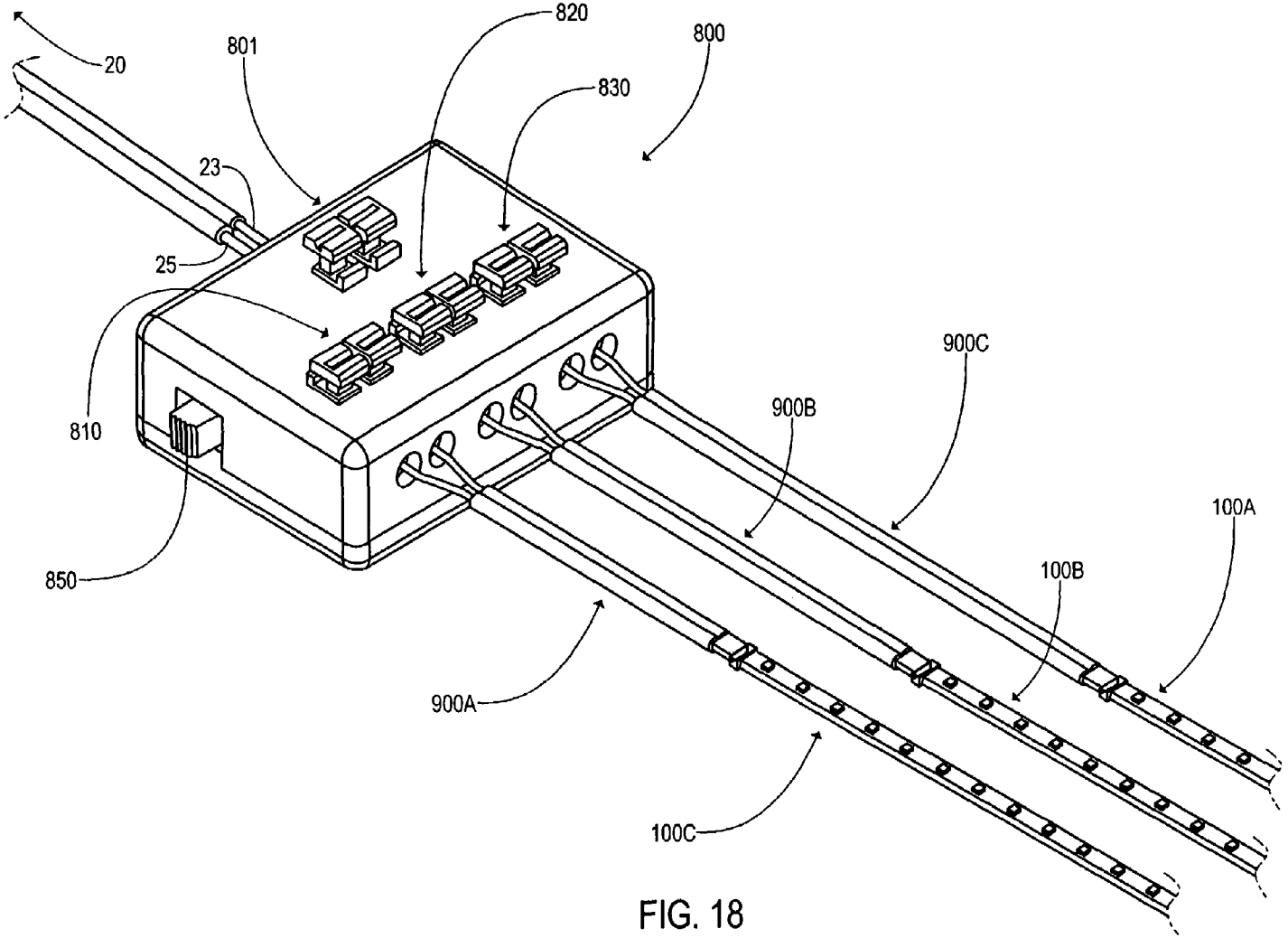
FIG. 18 shows the splitter of FIGS. 13 and 15 used with the connecting lines of FIG. 16 with three LED strips of FIG. 17.
Figure 19:
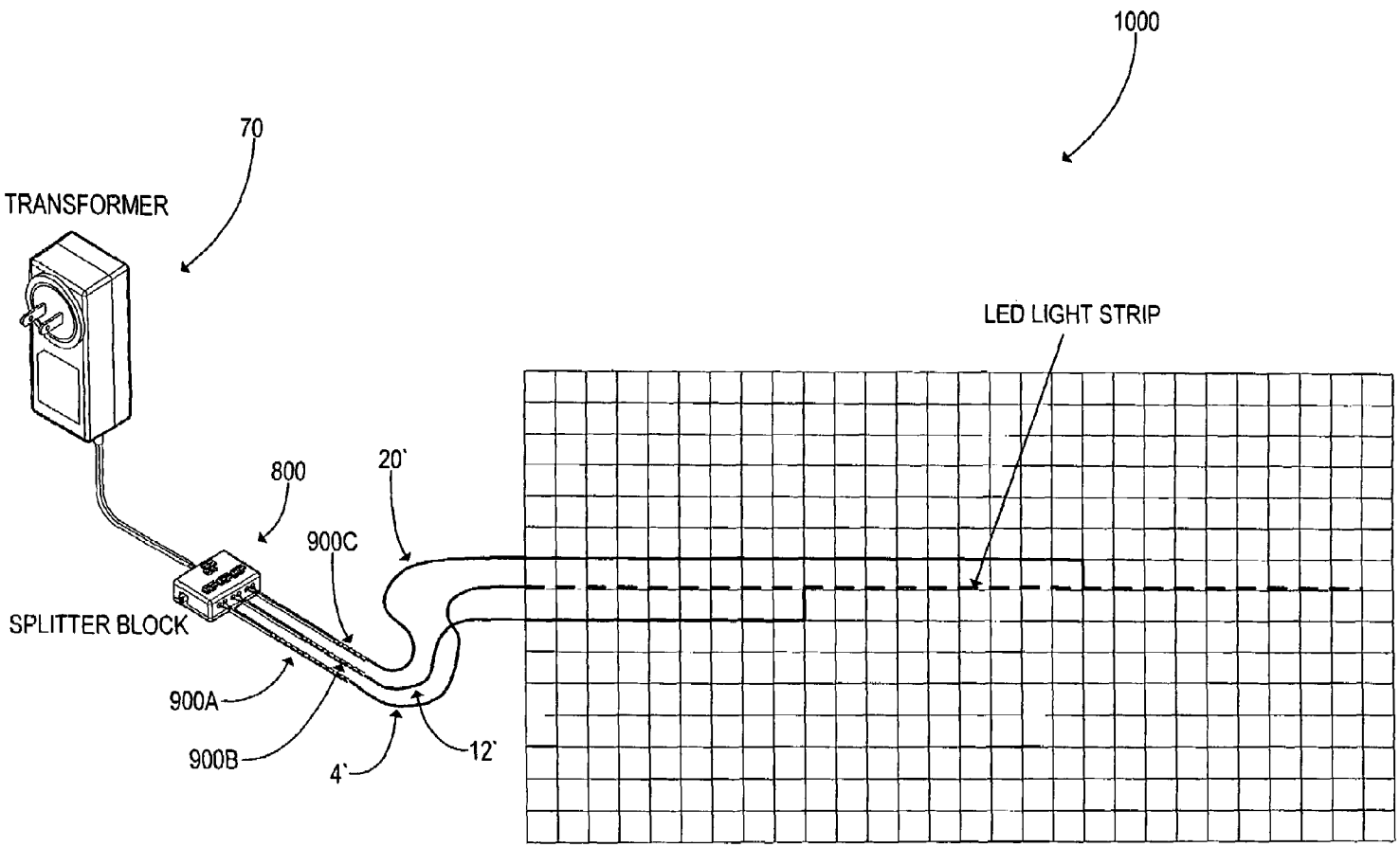
FIG. 19 shows an overall view of using the transformer with different length connector lines with three LED strips.

FIG. 16 is an enlarged view of one of the connecting lines 900 that can be used with the splitter 800. FIG. 17 is another view of an LED strip 100A for use with the splitter 800. FIG. 18 shows the splitter 800 of FIGS. 13 and 15 used with the connecting lines 900 of FIG. 16 with three LED strips of FIG. 17. FIG. 19 shows an overall view of using the transformer 20 with different length connector lines 900A, 900B, 900C with three LED strips 100A, 100B, 100C.

Referring to FIGS. 13 and 15, the splitter 800 can include Transformer Line Connectors 801 with positive terminal 802 for transformer line 801, and negative terminal 804 for transformer line 801. Splitter 800 can also include First Lead Line Connectors 810 with input socket 811 for positive terminal 810 for first lead line connector, and input socket 813 for negative terminal 814 for first lead line 810. Splitter 800 can have Second Lead Line Connectors 820 with input socket 821 for positive terminal 822 and input socket 823 for negative terminal 824. Splitter 800 can have Third Lead Line Connectors 830 with input socket 831 for positive terminal 832 and input socket 833 for negative terminal 834. An 850 On/Off Switch 850 such as a toggle switch and the like can turn the splitter 800 on and off.

The splitter box 800 can be sized to mount underneath a cabinet lip and have dimensions of approximately ¾" height by approximately 1 & ½" width by approximately 1¾" length. The novel size allows the splitter to be hidden from view when mounted under most cabinets.

In operation, the transformer 20 can be plugged into 120 Volt wall receptical, and the splitter box 800 can be used as an on/off power switch between the LEDs and the transformer 20. Additionally, the transformer 20 can be plugged into a wall outlet receptical whose power is controlled by a wall switch, where the wall switch can operate the LEDs.

FIGS. 13 and 15 are the splitter box (with a on/off switch 850) that connects the transformer 20 leads to three separate LED leads 100A, 100B, 100C that go into the tile installation.

Referring to FIG. 14, transformer 20 can have a power line cut to selected lengths with exposed positive conductive line 23 and negative conductive line 24 that feeds into transformer input sockets (not shown) for positive terminal 802 and negative terminal 804 of transformer line connectors 801 on the splitter 800. FIG. 14 is the transformer 20 that is designed to be used with the splitter block 800. Because the distance between the power source and the tile installation will vary the lead on this transformer can be cut to the length needed to accommodate the installation.

Referring to FIG. 16, a strip conductor lead wire 900 can include exposed light (positive conductor) 902 and exposed dark (negative conductor) 904 on one end, and female receptical 908 having double recepticals at an opposite end. The female receptical end can have colored indicia such as white paint on one side for indicating positive connection and dark paint on the other side for a negative connection point.

Referring to FIG. 17, an LED strip 100A can also have ends with colored indicia such as white paint for positive and dark paint for negative connection points. FIG. 17 is the light strip 100A with the edge of the connector painted white to denote the + side of the light strip.

FIG. 18 shows the three lead wires 900A, 900B, and 900C that can be available in approximately 4', approximately 12' and approximately 20' lengths. These lead wires allow the customer to light a straight line of LED light strips across the installation for a distance of approximately 27'.

Each lead line connector (810, 820, 830 from the splitter 800 can attach up to five (5) LED strip lines 100 in series. So that all three lead line connectors 810, 820, 830 can power up to 15 LED light strips (100) so that three parallel lines of five LED strips can be run and operated simultaneously. As previously described, one LED strip 100 can include up to 33 LEDs (light emitting diodes). The previously described transformer 20, such as 12V DC 4.5 Amp capability can be used for providing power for up to the 15 LED light strips simultaneously (three lead conductors 810, 820, 830).

The size of the transformer can be modified for different applications. For example, doubling the transformer to 10 Amps can allow for a splitter with five leads, each having up to five series connected LED strips connected to each lead. With five leads, up to 25 LED strips can be powered by the larger transformer.

Also, different applications can have plural transformers so that a bathroom or kitchen can have spaces separately lighted by different controlled transformers as needed.

Referring to FIG. 19, the first 5 LED light strips connect with the 4' lead and can extend along approximately 9' of tile grout joint. The second 5 LED light strips would connect to the 12' lead that is positioned in an alternate grout joint and turns into the first grout joint to continue the light for an additional ~9'. The third lead is positioned in a third grout joint and turns into the first grout joint to continue the light for another approximately 9' for a total of approximately 27' of light in one grout joint. See FIG. 19 for the details. FIG. 19 shows an overall view of using the transformer 20 with different length connector lines with three LED strips 100A, 100B, 100C.

Although the preferred embodiment references 33 LEDs per strip, the number of LEDs can reduced or increased depending upon the application. For example, a 21" long light strip can have 15 LEDs spaced approximately 3" apart from one another. For example, an approximately 21" long light strip can have 66 LEDs spaced approximately ¾" apart from one another.

The invention can be used with other transparent materials such as edges of mirrors, shelving and glass block. For example, with glass block, the peel and stick backing can allow the LED strip(s) to be directly mounted to a center depth portion of the block(s). With a 4" deep block the LED strip(s) can be mounted approximately 2" in from the edge of the glass block(s). Next, the grout can be applied over the top of the LEDs and the next block(s) be added (similar to building a brick wall).

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A tile lighting system comprising:

a plurality of glass tiles for being mounted on a surface, each of the glass tiles being separated from one another by a continuous spacing between each of the tiles;

a bottom layer of transparent removable grout for filling the continuous spacing between each of the grouts; and elongated LED strips placed positioned on the bottom layer of the transparent grout so that the LED strips are positioned approximately 2 mm to approximately 4 mm below a top surface of the tiles, the elongated LED strips having of a plurality of LEDs (light emitting diodes) encased in transparent sleeves, wherein the elongated strips include:

flexible plastic housing allows the LED strips to be bent up to approximately 45 degrees;

male and female ends that allow for the elongated strips to interconnect with one another:

separate plastic interconnect sleeves that overlaps where the elongated strips interconnect with one another; and a plastic end cap for protecting an end of the LED strips; and a top layer of the transparent removable grout over the elongated LED strips in the continuous spacing between the tiles, so that the LED strips are maintained in position approximately 2 mm to approximately 4 mm below top surfaces of the tiles.

2. The tile lighting system of claim 1, wherein the tiles further include additional tiles selected from at least one of: ceramic and stone tiles.

3. The tile lighting system of claim 1, wherein the continuous spacing between each of the tiles is a uniform width of approximately 3/16 of an inch wide.

4. The tile lighting system of claim 1, wherein the transparent removable grout includes clear silicon material.

5. The tile lighting system of claim 3, wherein at least one of the elongated strips has a flexible plastic housing that is bendable up to approximately 45 degrees and each strip includes 33 LEDs per strip that are spaced approximately 2.35 inches apart from one another.

6. The tile lighting system of claim 3, wherein at least one of the elongated strips has a flexible plastic housing that is bendable up to approximately 45 degrees and each strip has a height of approximately 0.20 inches and a width of approximately 0.14 inches.

7. The tile lighting system of claim 5, further comprising:

at least one transformer for providing power for up to approximately 15 LED strips.

8. A method of installing LEDs (light emitting diodes) in tile surfaces, comprising the steps of:

providing a plurality of LED strips, each strip containing a plurality of LEDs (light emitting diodes) housed in a flexible transparent plastic sleeve housing;

positioning a plurality of glass tiles on a surface so that joint spacings between the tiles have a uniform fixed width of approximately 3/16 of an inch apart from one another;

cleaning out the joint spacings between each of the tiles down to the surface;

laying a bottom layer of transparent grout in the joint spacings;

interconnecting separated ends of the LED strips together with male and female ends; and sliding transparent connector sleeves over the interconnected male and female ends;

capping and protecting an end of the LED strips:

positioning all the LED strips on the bottom layer of the transparent grout in the joint spacings, so that the LED strips are positioned approximately 2 mm to approximately 4 mm below a top surface of the tiles;

laying a top layer of the transparent grout in the joint spacings on top of the LED strips, so that the LED strips are maintained in position approximately 2 mm to approximately 4 mm below the top surface of the tiles; and allowing the top layer transparent grout and the bottom layer of the transparent grout to set in place.

9. The method of claim 8, wherein the providing step includes the step of:

providing a flexible housing for the LED strips that are bendable up to approximately 45 degrees and each strip includes 33 LEDs per strip that are spaced approximately 2.35 inches apart from one another.

10. The method of claim 9, further comprising the step of:

providing power for up to approximately 15 LED strips with one transformer.

11. The method of claim 8, wherein the providing step includes the step of:

providing the at least one elongated LED strip in the flexible housing that is bendable up to approximately 45 degrees and each strip has a height of approximately 0.20 inches and a width of approximately 0.14 inches.

12. The method of claim 8, wherein the providing step includes the step of:

providing the at least one elongated LED strip in the flexible housing with a removable backing layer over an adhesive surface, so that the backing layer is peelable from the at least one elongated LED strip, and the at least one elongated LED strip is attachable to the surface between the joint spacings.

13. The method of claim 8, wherein the step of laying transparent grout includes the step of:

laying removable clear Silicon grout in the joint spacings.

* * * * *